US012241714B2

(12) United States Patent
Khoshnood

(10) Patent No.: US 12,241,714 B2
(45) Date of Patent: Mar. 4, 2025

(54) SLING SHOT RIFLE

(71) Applicant: Bahram Khoshnood, Alpharetta, GA (US)

(72) Inventor: Bahram Khoshnood, Alpharetta, GA (US)

( * ) Notice: Subject to any disclaimer, the term of this patent is extended or adjusted under 35 U.S.C. 154(b) by 71 days.

(21) Appl. No.: 18/107,160

(22) Filed: Feb. 8, 2023

(65) Prior Publication Data

US 2024/0263907 A1 Aug. 8, 2024

(51) Int. Cl.
*F41B 3/02* (2006.01)
*F41B 3/00* (2006.01)

(52) U.S. Cl.
CPC ..... *F41B 3/005* (2013.01); *F41B 3/02* (2013.01)

(58) Field of Classification Search
CPC ..... F41B 3/005; F41B 3/02; F41B 7/08
USPC ..... 124/17, 20.3, 22
See application file for complete search history.

(56) References Cited

U.S. PATENT DOCUMENTS 3,006,330 A * 10/1961 De Bach ..... F41B 7/04 124/25
3,857,379 A * 12/1974 Burghardt ..... F41B 3/005 124/20.3
4,318,389 A * 3/1982 Kiss, Jr. ..... A01K 81/00 124/31
4,784,106 A * 11/1988 Kees ..... F41B 3/005 124/16
5,551,412 A * 9/1996 Warnke ..... F41B 3/005 124/20.1
6,564,787 B1 * 5/2003 Barry ..... F41B 3/005 124/20.1
7,464,701 B1 * 12/2008 Mendoza ..... F41B 7/08 124/20.1
8,925,535 B2 1/2015 Phillips
9,255,752 B2 2/2016 Phillips
9,395,139 B2 * 7/2016 Pena ..... F41B 3/02
9,605,922 B1 * 3/2017 Rowe ..... F41B 3/005
2013/0139799 A1 * 6/2013 Khoshnood ..... F41B 5/143 124/44.5
2014/0158103 A1 * 6/2014 Phillips ..... F41B 3/02 124/17

(Continued)

*Primary Examiner* — John E Simms, Jr.
(74) *Attorney, Agent, or Firm* — Walter A. Rodgers

(57) ABSTRACT

An improved sling shot rifle has an elongated rail, a stock operatively coupled to a first end of the elongated rail, the stock comprising a trigger and a catch releasably coupled to the trigger. A resiliently stretchable pouch comprising a closed first end, an open second end configured to be operatively coupled to the elongated rail, and an insert comprising an insert body having a first end, an opposite second end, a cylindrical cavity formed in the insert body second end and a first diameter wherein the back of the axial cavity is configured to receive a back end of an arrow. The insert further comprises a flange formed on the insert body first end wherein the flange comprises a second diameter that is larger than the first diameter. A ring is positioned around an outside surface of the resiliently stretchable pouch proximate the resiliently stretchable pouch first end so that the ring is received around the insert body adjacent the flange. A loop is operatively coupled to the ring at respective points that are opposite from each other on the ring, wherein the loop is configured to be releasably coupled to the catch.

19 Claims, 11 Drawing Sheets

(56) References Cited

U.S. PATENT DOCUMENTS

| | | | | |
|---|---|---|---|---|
| 2015/0260478 | A1* | 9/2015 | Park | F41B 3/005<br>124/20.3 |
| 2016/0290757 | A1* | 10/2016 | Khoshnood | F41B 5/123 |

* cited by examiner

SLING SHOT RIFLE

BACKGROUND

The present invention relates generally to sling shot rifles for shooting arrows and metal balls or pellets. More particularly, the present invention relates to a sling shot rifle having a trigger mechanism, a rail, an improved elastic pouch, and projectiles for use in the sling shot rifle.

Sling shot rifles have been in existence for some time. For example, U.S. Pat. No. 9,395,139 discloses a sling shot rifle that comprises a stock and butt having a trigger mechanism. Two rubberized bands 31 are coupled on one end to a respective spaced arm 18 and on the other end to a pocket 30. A loop 42 is coupled on one end to the pocket 30 and on an opposite end to a washer 100. The washer is used to couple the patch to a fire mechanism block 38.

The designs disclosed above for shooting arrows or round projectiles present many problems for the user. For example, in the case of both the sling shot rifle for shooting arrows or round metal projectiles, one of the many issues centers around the rubberized bands impart uneven reactive forces on the arrow or the sack when in the cocked position thereby causing the projectile or arrow to not fly where the shooter expects. Said another way, if one band exerts more force on one side of the pocket or the arrow, then the flight path of the arrow or the projectile can be off center making it more difficult for the user to hit their target. The present invention seeks to address many of the concerns that arise with modern sling shot guns shown in the prior art.

SUMMARY OF THE INVENTION

In one embodiment a sling shot rifle comprises (1) an elongated rail having a first end and an opposite second end, (2) a stock operatively coupled to the first end, (3) a body slidably received on the elongated rail intermediate the stock and the elongated rail second end, (4) a resiliently stretchable pouch having a closed first end and an open second end, and (5) a loop operatively coupled to the resiliently stretchable pouch closed first end.

In various embodiments, the stock further comprises a trigger operatively coupled to the stock and a catch operatively coupled to the trigger. In some embodiments, the slidable body further comprises a mounting ring and a spring-loaded locking pin operatively coupled to the slidable body, wherein the spring-loaded locking pin is configured to lock the slidable body to at least one particular position along the elongated rail intermediate the elongated rail first end and the elongated rail second end.

In various embodiments, the resiliently stretchable pouch open second end is configured to be operatively coupled to the mounting ring. In some embodiments, an insert configured to be received in the resiliently stretchable pouch first end comprises an insert body having a first end, an opposite second end, a cylindrical cavity formed in the insert body second end and a first diameter. The back of the axial cavity is configured to receive a back end of an arrow or pellet. A flange formed on the insert body first end comprises a second diameter that is larger than the first diameter. A ring is positioned around an outside surface of the resiliently stretchable pouch proximate the resiliently stretchable pouch first end so that the ring is received around the insert body adjacent the flange. A loop comprising a first end and a second end is operatively coupled to the ring at respective points that are opposite from each other. The loop is configured to be releasably coupled to the catch.

In other embodiments, a sling shot rifle comprises (1) an elongated rail having a first end and an opposite second end, (2) a stock operatively coupled to the first end, wherein the stock further comprises a trigger operatively coupled to the stock, and a catch operatively coupled to the trigger. In various embodiments, a slidable grip is operatively coupled to the elongated rail intermediate the first end and the second end. A generally cylindrical body is slidably received on the elongated rail intermediate the slidable grip and the elongated rail second end. The generally cylindrical body further comprises a resiliently stretchable pouch operatively coupled to the generally cylindrical body. The resiliently stretchable pouch comprises a closed first end having a loop operatively attached thereto and configured to engage with the catch, and an open second end. A spring-loaded locking pin is operatively coupled to the generally cylindrical body where the spring-loaded locking pin is configured to lock the generally cylindrical body to at least one particular position along the elongated rail intermediate the elongated rail first end and the elongated rail second end.

In various embodiments, the resiliently stretchable pouch open second end is secured to a generally circular ring that is coupled to the generally cylindrical body. In some embodiments, the generally circular ring is integrally formed with the generally cylindrical body. In some of these embodiments, a cover is operatively coupled to the generally circular ring, wherein the cover comprises a circular opening centered on the circular ring where the opening is configured to allow an allow shaft to slide therethrough and be supported by the walls of the opening. In various embodiments, at least two openings extending radially from the circular opening in the cover. In some embodiments, the circular opening is configured to support the shaft of an arrow (functions as an arrow rest) and the at least two openings extending radially from the circular opening are configured to allow the fletching of an arrow to pass therethrough without interfering with the flight of the arrow. In some embodiments, the cover is made from a flexible material, bristles, or any other material that functions as an arrow rest.

In some embodiments, the resiliently stretchable pouch further comprises an insert operatively received in the resiliently stretchable pouch closed first end. In various embodiments, the insert comprises (1) a first body comprising a first end, an opposite second end, a first diameter, a first length, and a cylindrical cavity formed in the first cylindrical body second end, and (2) a second body comprising a second diameter, and a second length. In some embodiments, the second body is positioned adjacent to the first body first end, the first diameter is smaller than the second diameter, the third inner diameter is substantially the same or slightly larger than the first diameter but smaller than the second diameter, and the first length is longer than the second length. In various embodiments, the insert is positioned in the resiliently stretchable pouch so that the first body second end cylindrical cavity opening faces the resiliently stretchable pouch open second end. In various embodiments, the insert first cylindrical body and the insert second cylindrical body are integrally formed from a polymer. In some embodiments, the first diameter is variable and is smaller at the insert first body second end and larger at the insert first body first end.

In various embodiments, a ring is positioned around the outside surface of the resiliently stretchable pouch where the ring comprises a third inner diameter. In various embodiments, the ring is received around an outside surface of the resiliently stretchable pouch over the insert first body proximate the insert first body first end and substantially abutting the insert second body. In some embodiments, the loop that is operatively coupled to the resiliently stretchable pouch and further comprises a first end and a second end wherein the loop first end and second end are operatively coupled to the ring. In various embodiments, the loop is formed from a metal wire or other flexible material such as a cord. In other embodiments, the loop may be formed from any suitable material such as a synthetic material, a natural cord material, etc.

In various embodiments, the first body cylindrical cavity contains a pin therein that is configured to engage a rear end of an arrow so that the arrow does not rotate when engaged with the pin. In various embodiments, the insert further comprises at least one magnet received in a radial recess that is tangent to an axis of the cylindrical cavity, wherein the at least one magnet is configured to magnetically retain a pellet in the insert cavity.

In various embodiments, the slidable grip further comprises a first body, a second body pivotally coupled to the first body, and a spring positioned intermediate the first body and the second body such that the spring biases the second body away from the first body. In some embodiments, when the second body is squeezed toward the first body, a portion of the second body engages with the elongated rail thereby causing the slidable grip to be temporarily fixed to the elongated rail so as not to slide. In various embodiments, the second body further comprises a friction material received by the second body such that when the second body is squeezed toward the first body, the friction material engages with the elongated rail causing the slidable grip to be temporarily fixed to the elongated body.

BRIEF DESCRIPTION OF THE DRAWINGS

Various embodiments of an apparatus, system, and method for utilizing a slingshot rifle having an elongated rail, a stock, and an elasticized pouch are described below. In the course of this description, reference will be made to the accompanying drawings, which are not necessarily drawn to scale, and wherein:

FIG. 9A is an exploded view and FIG. 9B is a sectional view;

DETAILED DESCRIPTION

Various embodiments now will be described more fully hereinafter with reference to the accompanying drawings. It should be understood that the invention may be embodied in many different forms and should not be construed as limited to the embodiments set forth herein. Like numbers refer to like elements throughout.

Description of Sling Shot Rifle

Figure 1:
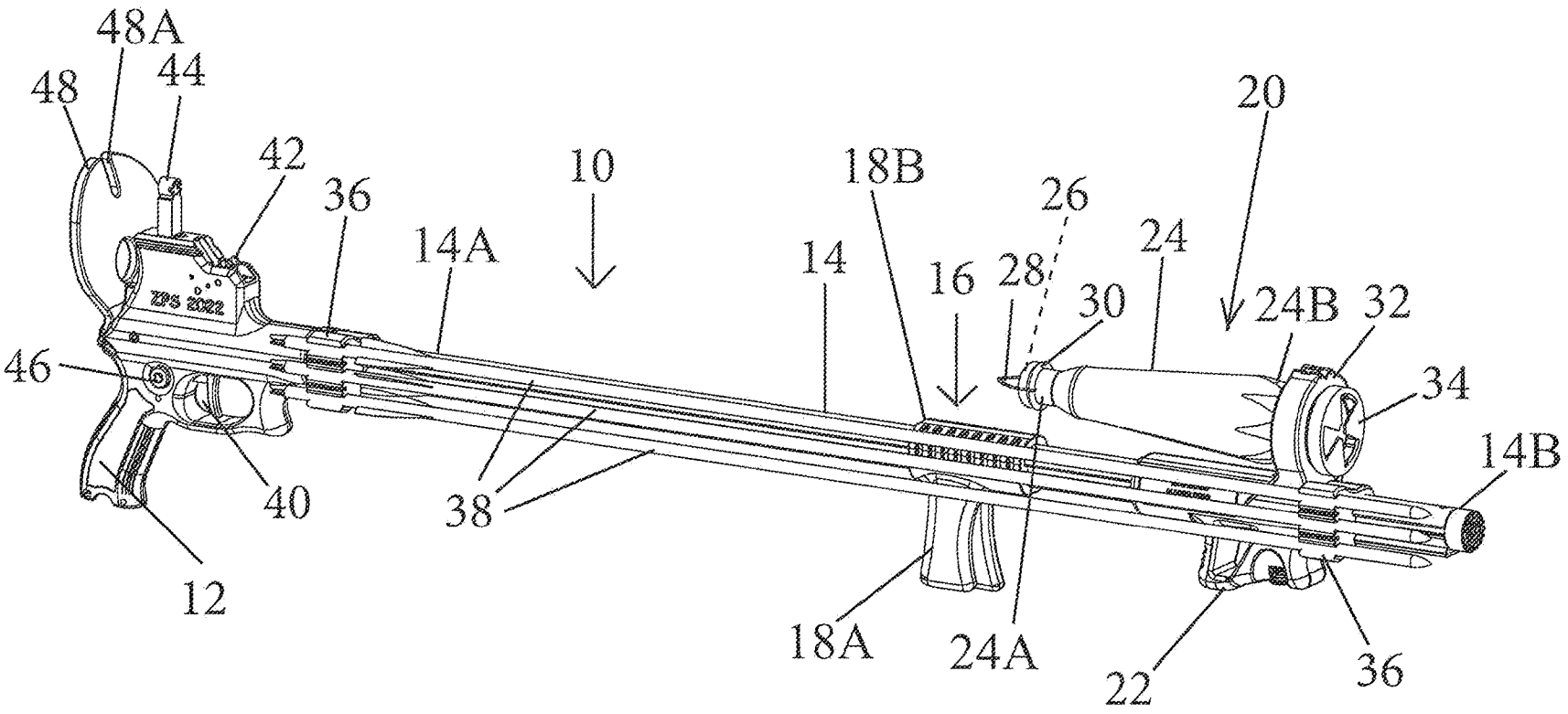
FIG. 1 is a perspective view of an embodiment of a sling shot rifle having a rail and a resiliently stretchable pouch.

Referring to FIG. 1, a sling shot rifle 10 having a stock 12, an elongated rail 14 having a first end 14A coupled to the stock, a slide grip 16, and a resiliently stretchable launch mechanism 20. The slide grip 16 comprises a grip handle 18A coupled to a generally cylindrical body 18B that is received on the elongated rail 14. Resiliently stretchable launch mechanism 20 comprises a generally cylindrical body 22 that is received on the elongated rail 14, a resiliently stretchable pouch 24 having a first end 24A and an opposite second end 24B.

Figure 2:
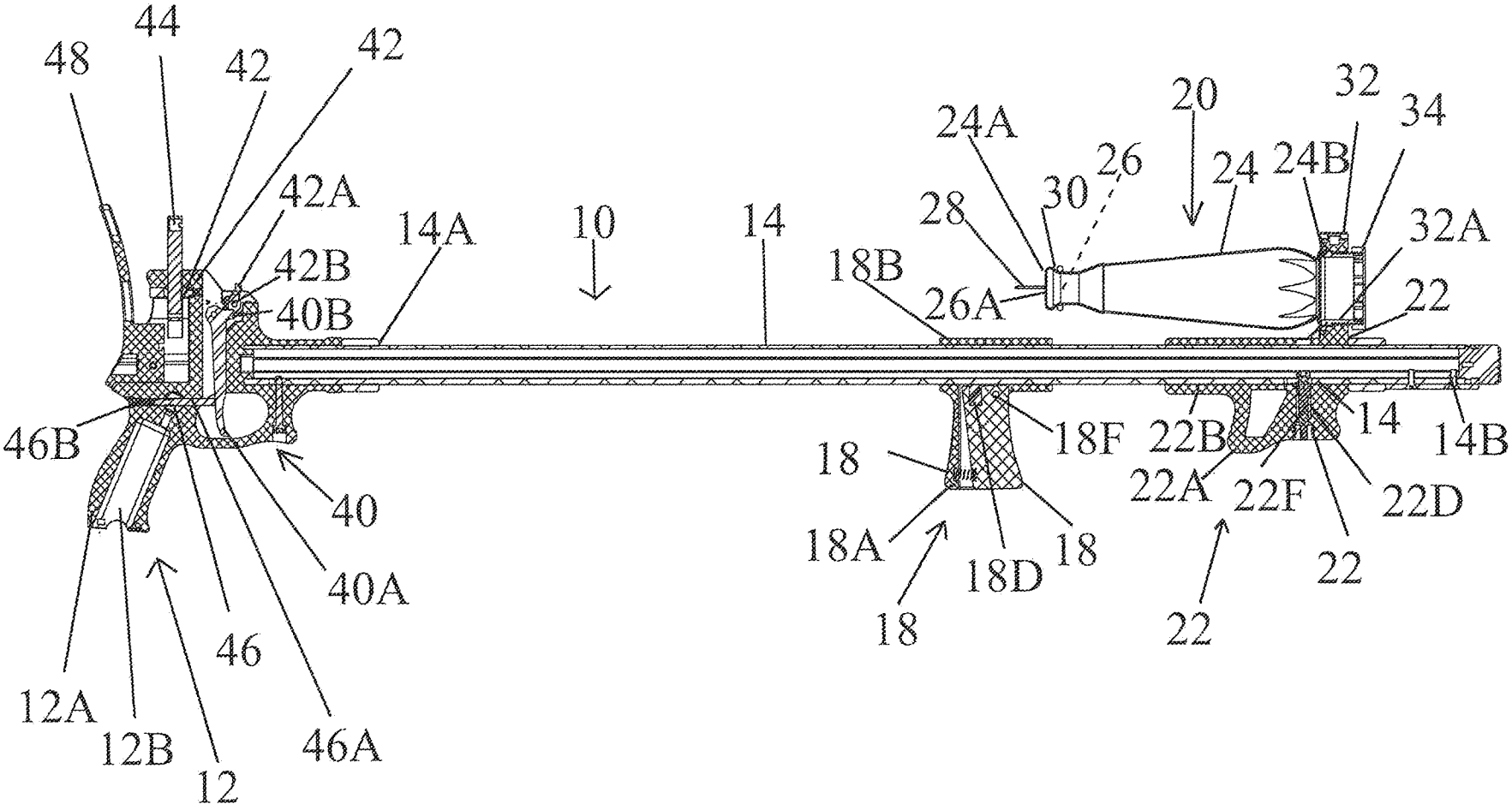
FIG. 2 is a side sectional view of the sling shot rifle of FIG. 1.

Resiliently stretchable pouch first end 24A contains within the pouch a generally cylindrical reinforced body 26 having a head (FIG. 2: 26A) with a larger diameter then the cylindrical body 26 (FIG. 2). A ring 30 made from any suitable material such as stainless steel, carbon fiber, a polymer, etc. is slid on the outside of resiliently stretchable pouch 24 along generally cylindrical reinforced body 26 until it seats against the head 26A (shown in FIG. 2). A loop 28 made from stainless steel wire, a polymer, carbon fiber material, etc. or any other suitable material is then coupled to ring 30 on opposite sides of ring 30. Loop 28 may be coupled by weldments, tying the loop material to ring 30 or by any other suitable means of coupling the ends of the loop material to ring 30.

Second end 24B of resiliently stretchable pouch 24 is coupled to generally cylindrical body 22. In various embodiments, generally cylindrical body 22 has a circular mounting body 32 either integrally formed with, or coupled to, generally cylindrical body 22. Second end 24B of resiliently stretchable pouch 24 can be secured to the circular mounting body in various suitable ways. In some embodiments, circular mounting body 32 may be formed from a first fixed body and a second insert body that allows the user to fold second end 24B of the resiliently stretchable pouch 24 over the first ring before it is removably inserted into the first fixed body. In other embodiments, second end 24B of the resiliently stretchable pouch 24 may be glued to circular mounting body 32. In still other embodiments, second end 24B of resiliently stretchable pouch 24 may be formed with an integral circular flange that may be coupled to circular mounting body 32 in various ways to secure second end 24B of the resiliently stretchable pouch to circular mounting body 32. A front cover 34 is formed from a flexible material such as rubber, polymer, elastomer, bristles, or any other suitable material that function as an arrow rest. Front cover 34 is attached to circular mounting body 32 by any suitable attachment means such a glue, threads, etc. Front cover 34 may be formed from any suitable material as mentioned above even a hard plastic, metal, etc. However, in preferred embodiments, the material is made from a flexible material so as not to interfere with the projectile being shot from the pouch.

For example, when an arrow is being shot from the pouch, you do not want the cover material on front cover 34 to interfere with the fletching of the arrow. Furthermore, if a pellet is being shot from the pouch and it is not traveling straight through the round opening in the cover, you also do not want front cover 34 to interfere with the trajectory of the pellet. In various embodiments, when shooting a pellet, the user may want to remove the cover so that it does not interfere with the flight of a pellet.

An arrow carrying system 36 may be mounted to first end 14A of elongated rail 14 and second end 14B of elongated rail 14 by suitable coupling means such as glue, weldments, attachments, etc. The arrow carrying system may be configured to carry one or more arrows 38. In various embodiments, the arrow carrying system 36 may be mounted on one or both sides of the elongated rail 14.

Stock 12 contains a trigger mechanism 40 and a hook 42 that is operatively coupled to trigger mechanism 40. A safety device 46 is operatively coupled to trigger mechanism 40 to prevent the trigger from being inadvertently pulled when the user is not ready to shoot the sling shot gun. A blow back plate 48 is mounted to the back of stock 12 to prevent accidental blow back of any debris into the user's eyes. In various embodiments, blow back plate 48 may be made from any suitable material. In preferred embodiments, blow back plate 48 is made of a clear polymer to allow the user to see where they are aiming the sling shot gun. In various embodiments, the blow back plate contains a vertical slot 48A that allows the user to have a clear line of vision to a sighting mechanism 44. In some embodiments, sighting mechanism 44 can be a standard sighting mechanism, a laser sight, a lighted dot sight or any other suitable sighting mechanism.

Stock

Referring to FIG. 2, stock 12 may be formed from any suitable material such as s polymer, a metal, a metal alloy, etc. and comprises a handle 12A. Handle 12A in various embodiments may comprise a hollow cavity 12B that is configured to removably receive a magazine (e.g., storage compartment) configured to hold one or more pellets (e.g., round balls, slugs, etc.) or any other material the user wishes to carry. Stock 12 is also configured to receive trigger 40. Trigger 40 comprises an elongated lever having a first end 40A configured to receive input from the user, a second end 40B that is configured to engage with the hook 42. Hook 42 may be formed in various configurations, and in preferred embodiments, hook 42 is formed from a generally circular body 42A that is operatively held in stock 12 by a pin 42*b*. Generally circular body 42A is operatively engaged with second end 40B of trigger 40. A spring 42C is operatively positioned between stock 12 and generally circular body 42A and biases the hook 42 into the vertical position as shown in FIG. 2.

Stock 12 also houses a safety button 46 (FIGS. 1& 2) that is operatively engaged with a safety pin 46A. A spring 46B is operatively positioned between an end of pin 46A and stock 12 and is configured to bias pin 46A toward elongated rail first end 14A. In operation, if safety button 46 (FIGS. 1 and 2) is not pushed, pin 46A blocks trigger lever first end 40A from being puller rearward. When safety button 46 is depressed, trigger first end 46A can be pulled rearward against bias of spring 46B thereby disengaging trigger second end 40B from hook cylindrical body 42A.

Grip

Still referring to FIG. 2, grip 18 comprises a grip body 18A, a generally cylindrical body 18B and a trigger 18C. Generally cylindrical body 18B is slidably mounted on elongated rail 14 intermediate elongated rail first end 14A and second end 14B. Trigger 18C is rotatably coupled to grip body 18A by a pin 18F. A spring 18E is positioned between grip body 18A and trigger 18C. An insert 18D is received in a cavity (not labeled) in trigger 18C such that when the trigger 18C is not squeezed, spring 18E biases trigger 18C forward away from grip body 18 so that insert 18D does not engage with elongated rail 14. Insert 18D may be made from any suitable material such as a polymer, elastomer, rubber, or any other suitable material that causes a frictional grip when trigger 18C is squeezed toward grip body 18A thereby causing insert 18D to engage with elongated rail 14.

Generally Cylindrical Body

Generally cylindrical body 22 comprises a first portion 22A that extends from a generally cylindrical second portion 22B and a third portion 22C that extends from the second portion 22B. In various embodiments, first, second and third portions 22A, 22B and 22C may be formed from two separate parts that are coupled together. In other embodiments, first, second and third portions 22A, 22B and 22C may be integrally formed from any suitable material (e.g., polymers, metals, etc.). Generally cylindrical body 22 further comprises a pin 22D that is received in a cavity (not numbered) formed in first portion 22A. Pin 22D is surrounded by a spring 22F that is positioned around pin 22D and radially inwardly biased toward elongated rail 14. Generally cylindrical body 22 is configured to be slidably received on elongated rail 14 and can slide between elongated rail first end 14A and second end 14B. In various embodiments, pin 22D is configured to be received in at least one opening 14C formed in elongated rail 14 so that generally cylindrical body 22 can be secured at the at least one particular location on elongated rail 14. Generally cylindrical body third portion 22C is configured to be mounted to resiliently stretchable launch mechanism 20 as explained in more detail below. In various embodiments, it should be understood that generally cylindrical body 22 may be formed without pin 22D.

Resiliently Stretchable Launch Mechanism

Figure 3:
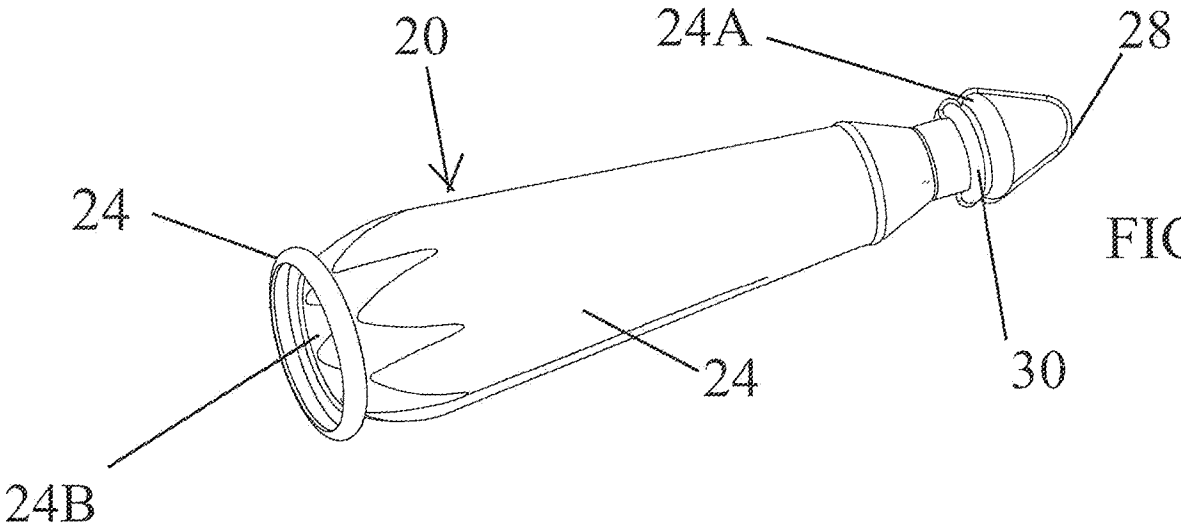
FIG. 3 is a perspective view of the resiliently stretchable pouch of the sling shot rifle of FIG. 1.

Referring to FIG. 3, resiliently stretchable launch mechanism 20 comprises the resiliently stretchable pouch 24. Resiliently stretchable pouch 24 may be formed from any stretchable material such as a stretchable polymer, elastomer, rubber, latex, etc. or any other suitably stretchable compound. In various embodiments, resiliently stretchable pouch 24 comprises a closed first end 24A and an open second end 24B. Closed first end 24A may be reinforced (e.g., formed from thicker walls, reinforced with a laminate material, etc.) to strengthen the material. Second open end 24B may be formed with a uniform thickness similar to the center portion of the pouch or it may be formed with a thicker wall or lip portion 24C (FIG. 3). Resiliently stretchable pouch second end 24B is operatively coupled to generally cylindrical body third portion 22C by circular mounting body 32.

In some embodiments, resiliently stretchable pouch second end 24B may be glued to circular mounting body 32 (FIG. 2), pinch fit between circular mounting body 32 and a ring 32A (FIG. 2) that is press lit into, threaded on circular mounting body 32, or secured in any other suitable fashion that securely couples resiliently stretchable pouch second end 24B to circular mounting body 32. In various embodiments, generally cylindrical body third portion 22C and circular mounting body 32 are formed as separate parts. In other embodiments, generally cylindrical body third portion 22C and circular mounting body 32 are integrally formed. In various embodiments, resiliently stretchable pouch 24 is elongated in length and in some embodiments, it may be tapered in diameter between resiliently stretchable pouch first end 24A and resiliently stretchable pouch second end 24B. In some embodiments, the diameter at first end 24A is smaller than the diameter of second end 24B.

In operation, the closer generally cylindrical body 22 is fixed to elongated rail second end 14B, the more force will be exerted on a projectile shot from resiliently stretchable pouch second end 24B when resiliently stretchable pouch first end 24A is released from the catch 42. Thus, when shooting close targets or small varmint, generally cylindrical body 22 may be fixed at a position more distal from the resiliently stretchable pouch second end 24B.

Improved Resiliently Stretchable Launch Mechanism

Referring to FIG. 3, resiliently stretchable launch mechanism 20 is formed from a stretchable pouch 24 having an inner surface and an outer surface. Stretchable pouch 24 has a closed first end 24A, an open second 24B and a lip 24C. Lip 24C may be formed from curved material or it may be formed as a circular bead. In either case, lip 24C is configured to be received by a mounting ring 32 (FIG. 2).

Figure 4:
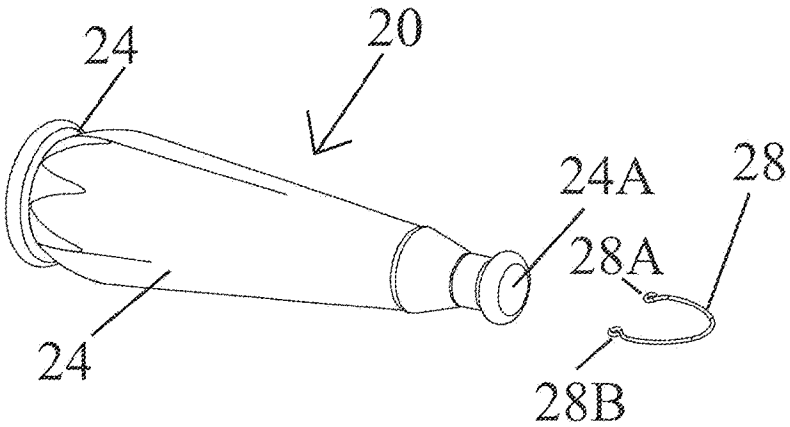
FIG. 4 is an exploded view of the resiliently stretchable pouch of FIG. 3.
Figure 4A:
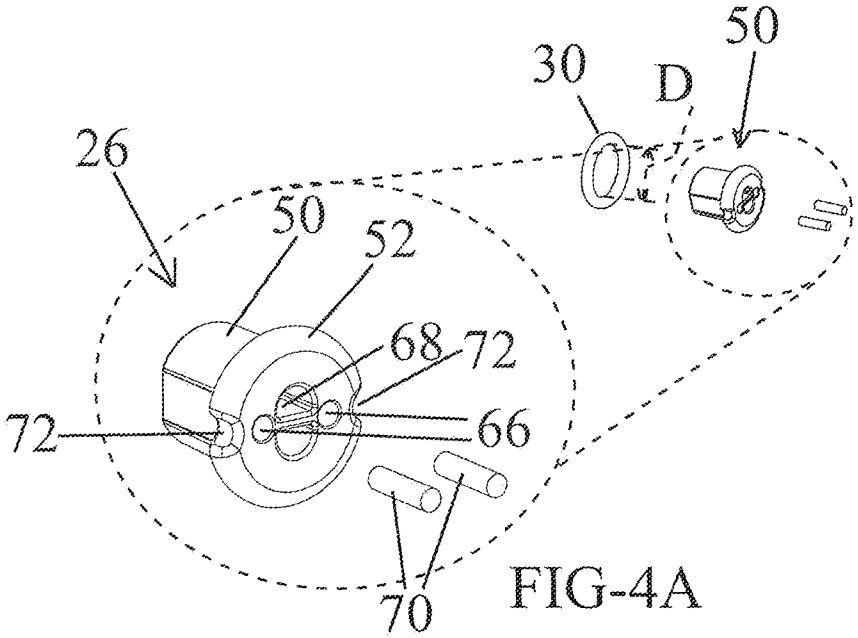
FIG. 4A is a zoomed in perspective view of the insert from the resiliently stretchable pouch of FIG. 4.

Referring to FIGS. 3, 4 and 4A, an insert 26 configured to be received in stretchable pouch closed first end 24A. In particular, insert 26 is placed into open second end 24B of the pouch and moved into closed first end 24A. Once seated, ring 30 is slide over the outside of open second end 24B of the pouch and seated over insert 26. Loop 28 is positioned so that it extends rearward of closed pouch first end 24A. Ends 28A and 281B of loop 28 are attached to opposite sides of ring 30 by any suitable means such as weldments, glue, fasteners, or by wrapping and twisting the ends to the wire around itself or tying two ends of a cord around ring 30.

Figure 8:
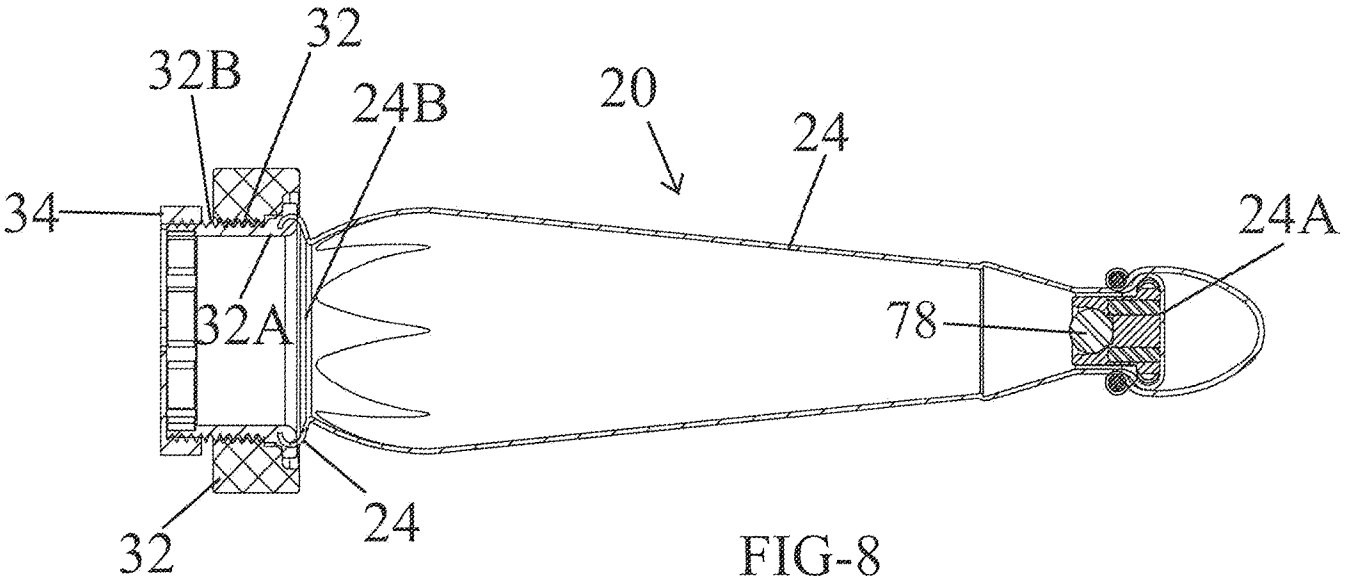
FIG. 8 is a sectional view of another embodiment of the resiliently stretchable pouch for use in the sling shot rifle of FIG. 1.

Referring now to FIGS. 5A, 5B, 6 and 7 insert 26 comprises an insert first body 50 and an insert second body 52. Insert first body 52 has a first end 54, a second end 56, a first length 58, and a first diameter D1. In various embodiments, an axial cavity 56A extends inward from first body second end 56 and contains a curved base 56B. Curved base 56B is configured to seat a round pellet 78 (FIG. 8). Insert second body 52 also comprises a first end 60, a second end 62, a second length 64, and a second diameter D2. In various embodiments, insert first body 50 may be generally cylindrical in shape, and insert second body 52 may also be cylindrical in shape.

In some embodiments, insert first body first length 58 is longer than insert second body second length 64. In other embodiments, the insert first body length 58 many shorter than the insert second body second length, and in still other embodiments, the two lengths may be substantially the same (i.e., equal lengths). In some embodiments, insert first body 50 and insert second body 52 are separately formed and coupled together using a suitable coupling such as weldments, glue, fasteners, etc. In other embodiments, insert first body 50 and insert second body 52 are made from a suitable material such as polymer, rubber, elastomer, etc. and are integrally formed together. In various embodiments, insert first body first diameter D1 is smaller than insert second body second diameter D2. Accordingly, in these embodiments, insert second body 52 functions as a flange that ring 30 seats against.

Figure 5B:
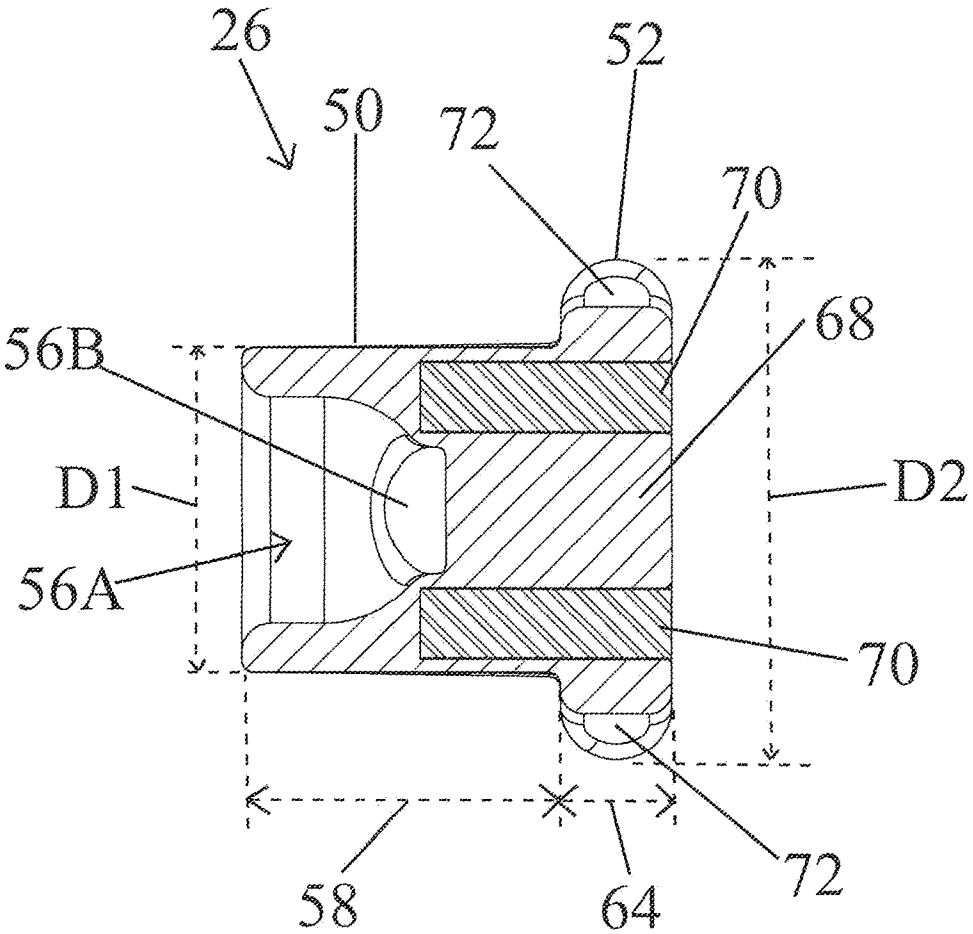
FIGS. 5A and 5B are sectional views of the insert shown in FIG. 4A, where the sectional view of FIG. 5B is taken through the insert 90 degrees rotated from the insert position shown in FIG. 5A.

In various embodiments, one or more cavities 66 (FIG. 4A) may be formed through insert first body 50 and insert second body 52. One or more magnets 70 are configured to be placed in a respective one of the one or more cavities 66 so that the ends of the one or more magnets 70 are configured to retain round pellet 78 (FIG. 8) in the curved base 56B. Said another way, the ends of one or more magnets 70 are positioned proximate to curved base 56B (as shown in FIG. 5B) thereby magnetically retaining a pellet in curved base 56B. In some embodiments, a pin or tab 68 may be formed in insert 26 such that the tab is accessible from the rear of axial cavity 56A proximate to curved base 56B. Tab 68 is configured to receive the nock arrow. It should be understood that other structure for retaining the pellet in the insert are within the scope of the present invention. For example, the insert radial cavity 56A may contain additional material such as a rubber or elastomer material that is configured to releasably retain the pellet in the cavity.

In various embodiments, insert second body 52 may also contain two recesses 72 formed in an outer surface of insert second body 52 on opposite sides of insert second body 52 (FIG. 5B). Recesses 72 are configured to provide space for loop 28 first end 28A and second end 28B to attach to ring 30 as shown in FIG. 3. In this way, the recesses help prevent loop 28 from digging into pouch 24. Another reason to have recesses 72 is to rotationally retain ring 30 in its proper position and to prevent it from rotating around the insert.

In various embodiments, insert first body first diameter D1 may vary along the length of insert first body 50 between insert body first end 54 and insert body second end 56 so that first diameter D1 at insert body first end 54 is larger than first diameter D1 at insert first body second end 56. In these embodiments, when ring 30 is slipped over the outer surface of resilient stretchable pouch 24 and over insert first body 50, ring 30 will wedge against an insert first body outer surface as it approaches and abuts against insert second body second end 62.

Referring to FIG. 8, resiliently stretchable launch mechanism 20 is shown coupled to circular mounting body 32 and ring 32A from FIG. 2. Ring 32A has a thread 32B formed on an outer surface. In some embodiments, ring 32A is threaded into mounting body 32 as shown in FIG. 8. In this configuration, stretchable pouch lip 24C is press fit between mounting body 32 and ring 32A. A cover 34 like the one described in FIGS. 1 and 2, is coupled to an end of ring 32A. In other embodiments, ring 32A may be press fitted into mounting body 32 instead of threadedly coupled thereto.

Figure 9B:
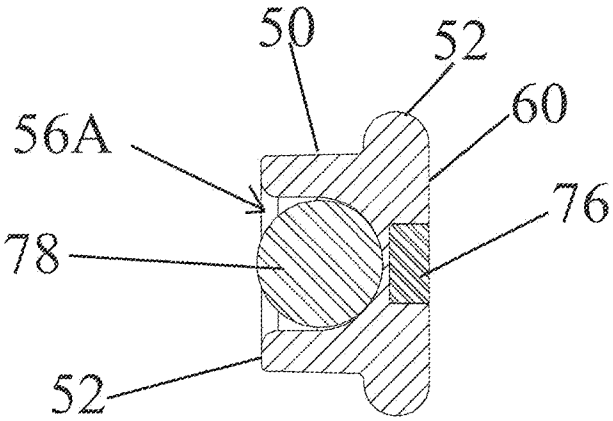
FIGS. 9A and 9B are another embodiment of an insert for use in the resiliently stretchable pouch of FIGS. 6, 7 & 8, where
Figure 9A:
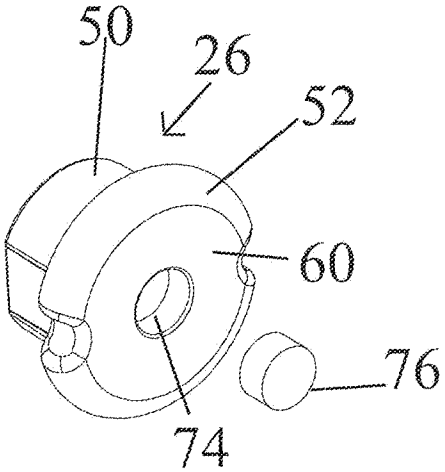

Referring to FIGS. 9A and 9B, a second embodiment of an insert 26' like the insert of FIGS. 4A-8 has a first body 50 and a second body 52. For purposes of discussion, the description associated with FIGS. 4A, 5A and 5B apply to insert 26'. As such and for brevity, only the differences associated with insert 26' will be discussed herein. Insert 26' has a blind cavity 74 formed in insert second body first end that is configured to seat a magnet 76 therein. A cavity 56A' is formed in insert first body second end 52 and is configured to receive round pellet 78. Magnet 76 is configured to releasably retain round pellet 78 in cavity 56A. In this second embodiment, insert 26' is only configured to receive and shoot a pellet (e.g., round ball, slug, etc.) and can also shoot an arrow that has a small steel nock since the magnet will retain the steel nock in the cavity.

Operation of the Sling Shot Rifle

Figure 10A:
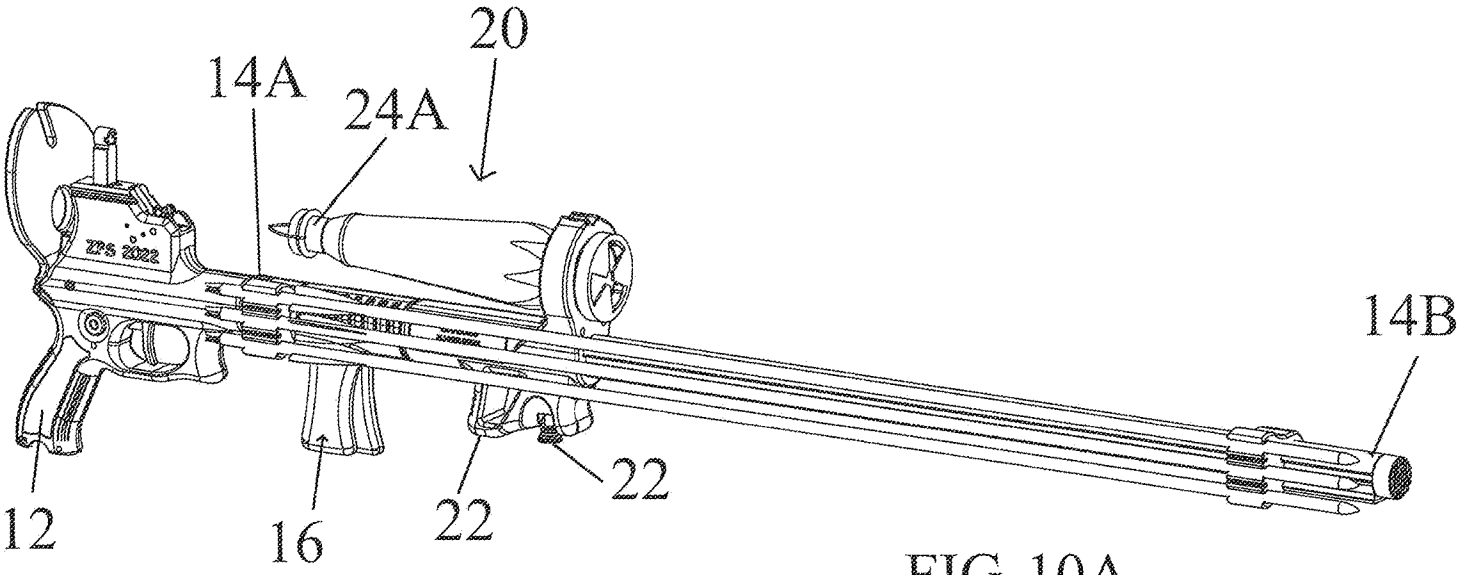
FIG. 10A is a perspective view of the sling shot rifle of FIG. 1 with the resiliently stretchable pouch moved from an initial position shown in FIG. 1 to a second position shown in FIG. 10A.
Figure 10B:
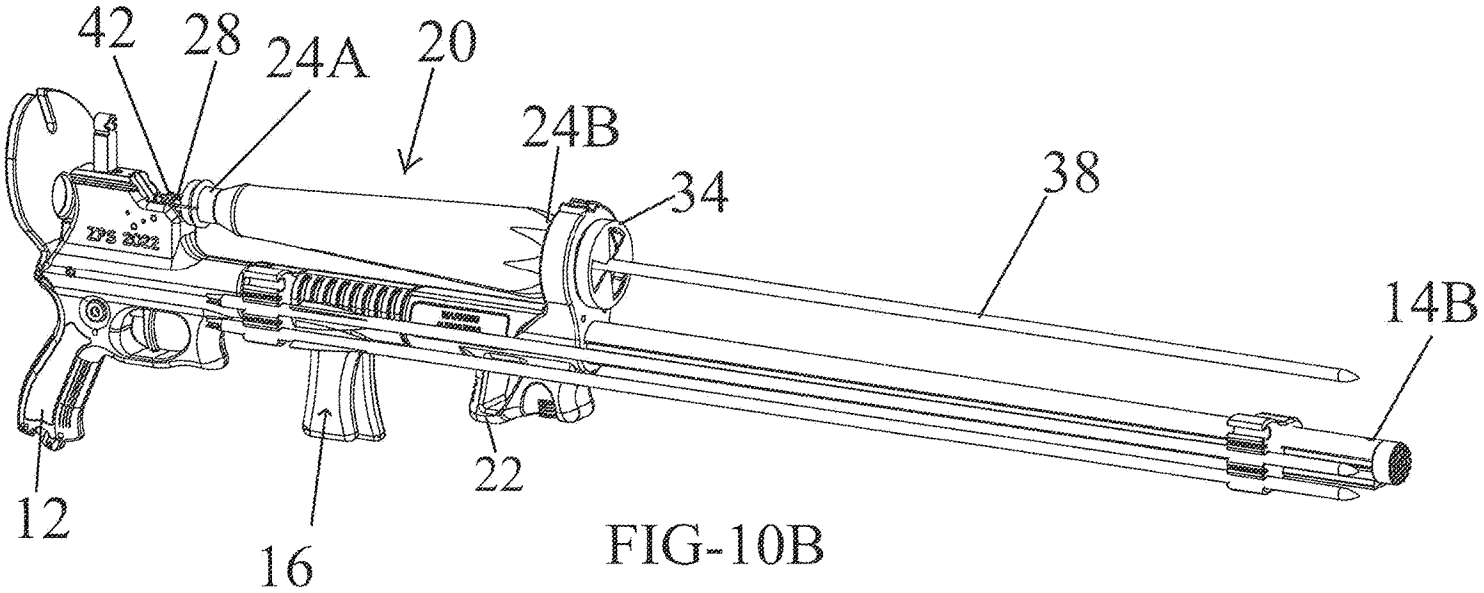
FIG. 10B is a perspective view of the sling shot rifle of FIG. 10A with the rear end of the resiliently stretchable pouch attached to a trigger mechanism and an arrow loaded into the resilient stretchable pouch.

Referring to FIGS. 10A-10D, in operation of the sling shot rifle, FIG. 10A shows slide grip 16 and generally cylindrical body 22 moved rearward in a first position proximate elongated rail first end 14A. Generally cylindrical body 22 is moved by the user by pulling pin head 22E downward thereby disengaging pin 22D (FIG. 2) from elongated rail 14 proximate the elongated rail second end 14B. Referring to FIG. 10B, once the generally cylindrical body 22 is in the first position, the user than grasps stretchable pouch closed first end 24A and insert 26 and pulls the loop 28 toward catch 42 until the loop is releasably engaged with catch 42. Once this step is complete and the sling shot rifle is in the second position, the user may then load an arrow 38 into the pouch open end 24 through cover 34 until the back end of the arrow is nocked on tab 68 (FIG. 6) in insert 26. Cover 34 functions as an arrow rest thereby aligning the arrow flight with sight 44.

Figure 10C:
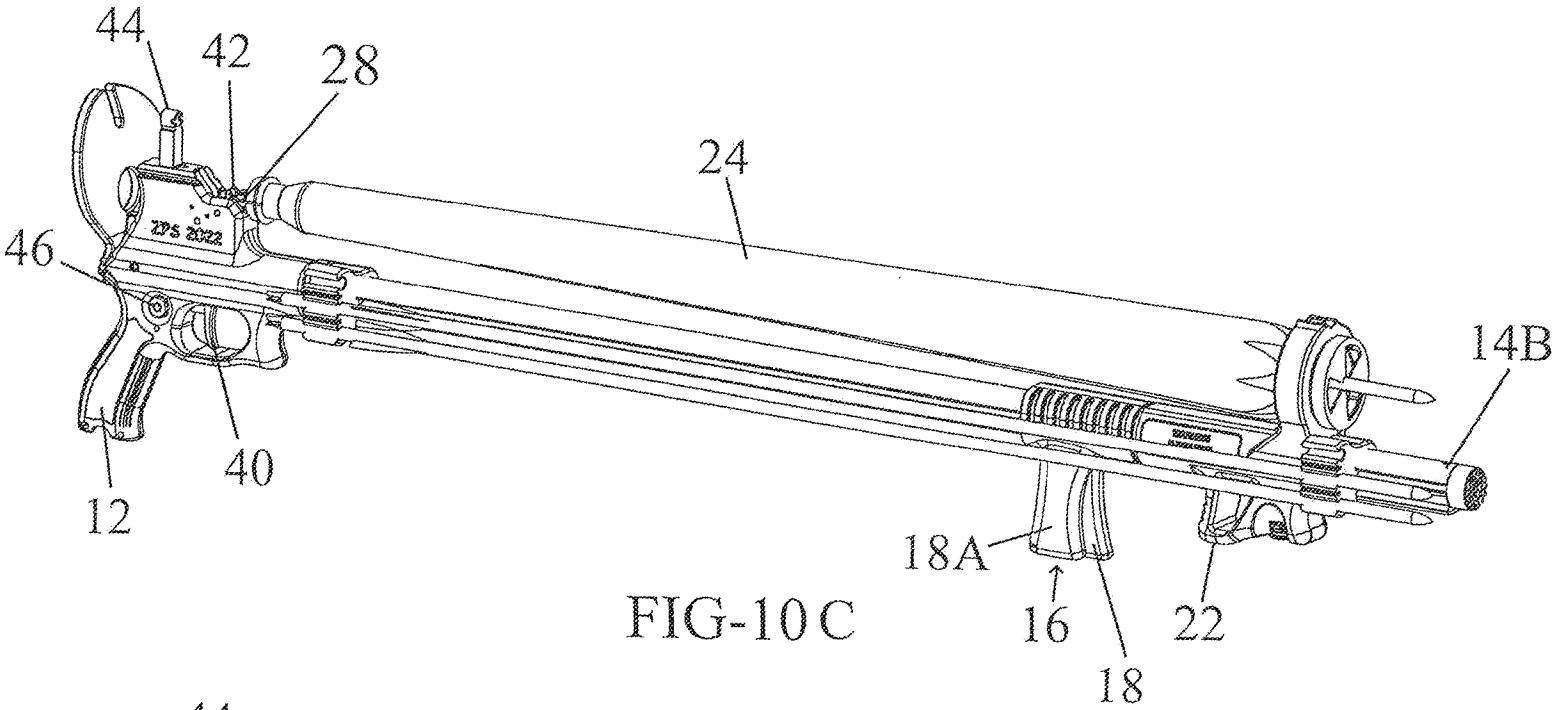
FIG. 10C is a perspective view of the sling shot rifle of FIG. 10B with the open second end of the resiliently stretchable pouch moved to a third position with the generally cylindrical body locked in place so that the pouch is in a fully stretched position.

To cock the sling shot rifle, and referring to FIG. 10C, the user holds grip 12 with one hand while grasping slide grip 16 being careful not to squeeze grip body 18A and grip trigger 18C together so as not to fix slide grip 16 to elongated rail 14. The user than pushes slide grip 16 forward out of the second position thereby pushing generally cylindrical body 22 forward until the pin 22D (FIG. 2) engages with at least one opening 14C in elongated rail 14 in to a cocked third position. Once pin 22D engages with the at least one opening 14C, stretchable pouch 24 will be in a fully loaded third position. Said another way, stretchable pouch 24 will be fully extended and ready to fire arrow 38 or another projectile loaded in insert 26 such as a round pellet ball, slug, etc. Comparing FIGS. 10B and 10C, as pouch open second end 24B is moved forward toward elongated rail second end 14B, the arrow body is pulled into stretched stretchable pouch 24.

Figure 10D:
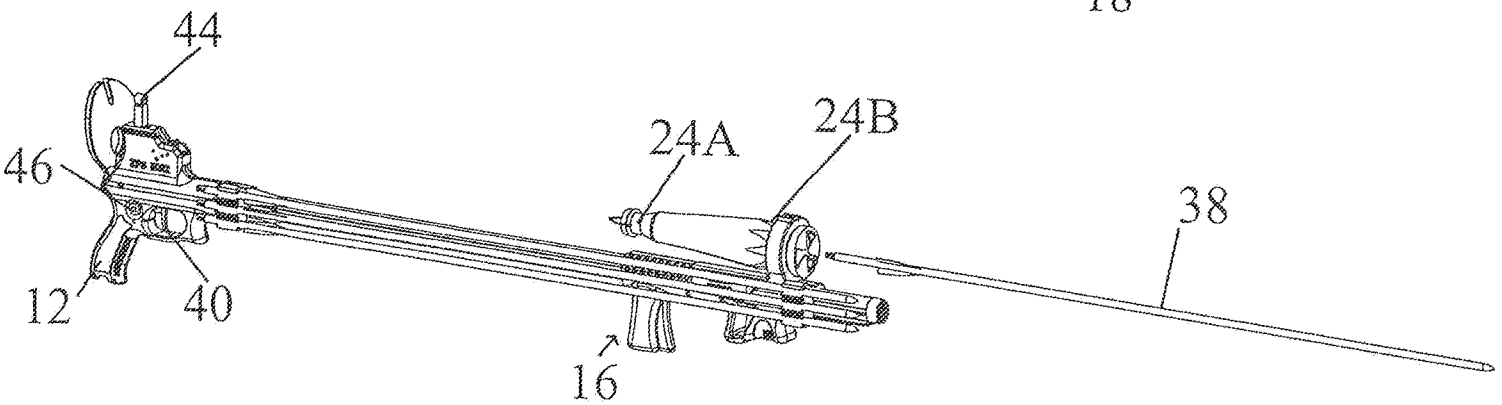
FIG. 10D is a perspective view of the sling shot rifle of FIG. 10C just after the trigger is pulled and the rear end of the resilient stretchable pouch returns to the initial position thereby ejecting the arrow from the pouch.

Referring to FIGS. 10C and 10D, once the slingshot rifle is cocked and in the third position as shown in FIG. 10C, the user can move slidable grip 16 to any comfortable position since generally cylindrical body 22 is locked in place. Once the user moves slidable grip 16 into a comfortable position, the user can squeeze grip body 18A and grip trigger 18C thereby causing the slidable grip to become frictionally fixed to elongated rail 14. The user may then aim the sling shot rifle using sight 44. When the user is ready to fire the arrow, the user depresses safety button 46 allowing trigger 40 to be pulled rearward toward grip 12. Once safety button 46 is depressed, the user can pull trigger 40 causing catch 42 to be released. As catch 42 is released, it can rotate allowing loop 28 to be released. Stretchable pouch closed first end 24A snaps forward as stretchable pouch 24 unstretches and returns to its unstretched state as shown in FIG. 10D causing the arrow 38 to be catapulted forward. When the arrow or other projectile is fired, the sling shot rifle returns to its initial position shown in FIG. 1.

In various embodiments, the locking pin system of generally cylindrical body 22 may be removed and instead of the pin locking generally cylindrical body 22 in the third position, the user instead retains the generally cylindrical body 22 in the third position using slidable grip 16 by squeezing the grip trigger 18C with the grip body thereby causing the slidable grip 16 to be frictionally locked to the elongated rail 14. In this configuration, the user must maintain the slingshot rifle in the third cocked position with the slidable grip or generally cylindrical body 22 will naturally return to the second position as a safety feature.

Alternate Embodiments

Figure 11:
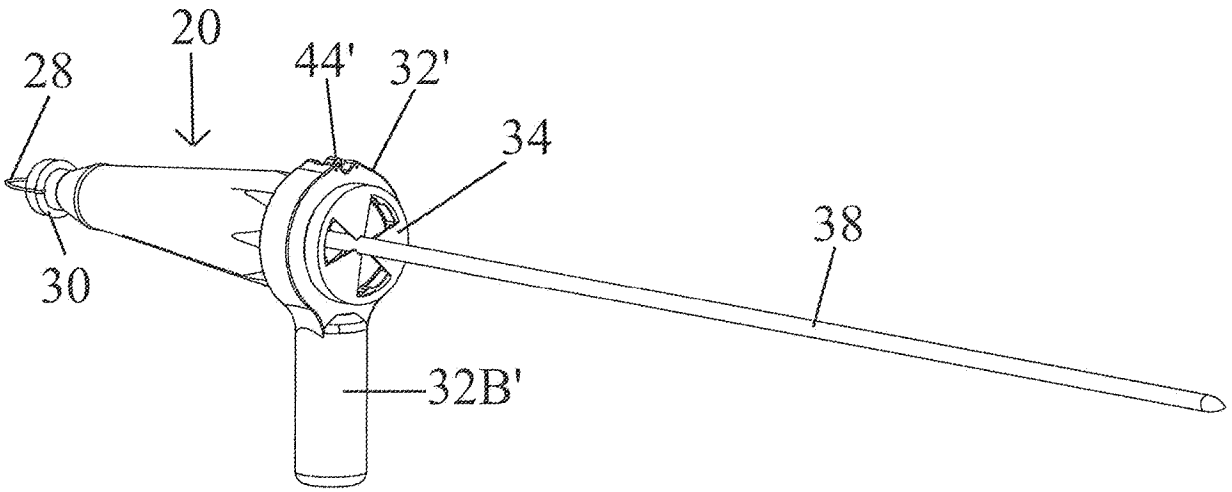
FIG. 11 is perspective view of another embodiment of a handheld slingshot using the resiliently stretchable pouch of FIG. 3
Figure 12:
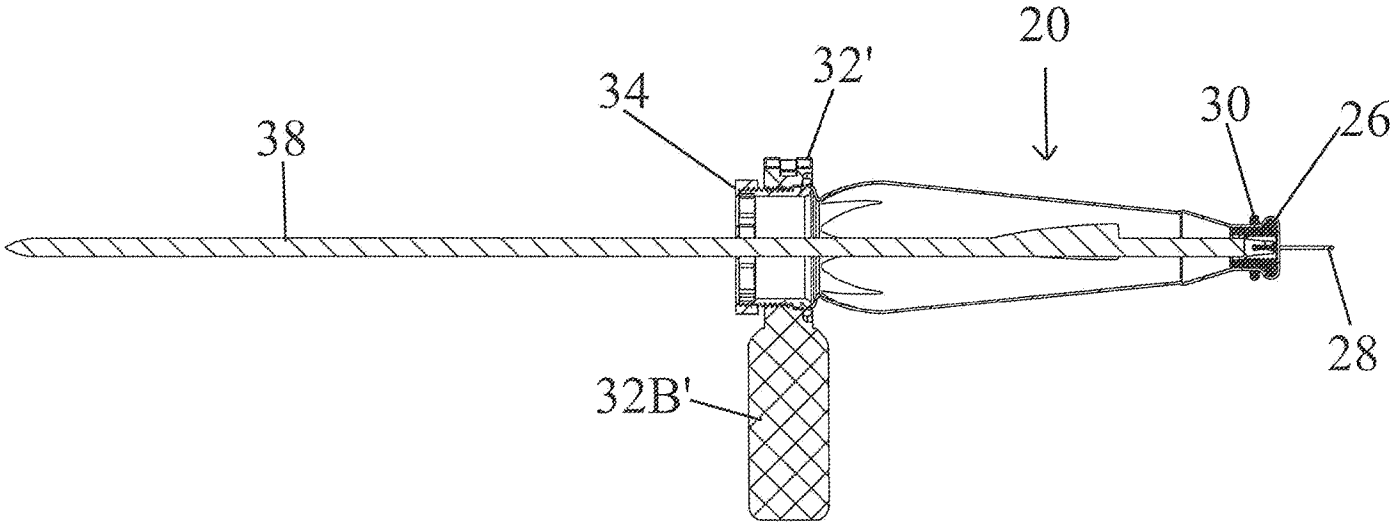
FIG. 12 is sectional view of the slingshot of FIG. 11 with an arrow nocked in the insert.

Referring to FIGS. 11 and 12, an alternate embodiment of a handheld slingshot is shown using the resiliently stretchable pouch shown in FIGS. 3-7. In various embodiments, the circular ring 32' is mounted to a handle 32B'. In all other aspects, the resiliently stretchable pouch 20, insert 26 and ring 30 function the same as described in FIGS. 3-7. In the embodiment shown in FIGS. 11 and 12, the user holds handle 32B' with one hand and pulls back on loop 28 with the other hand thereby stretching the resiliently stretchable pouch. When the user wants to shoot a projectile (e.g., arrow 38 or a pellet), the user releases the loop 28. The user can aim the projectile using a mechanical sight 44'.

Figure 5A:
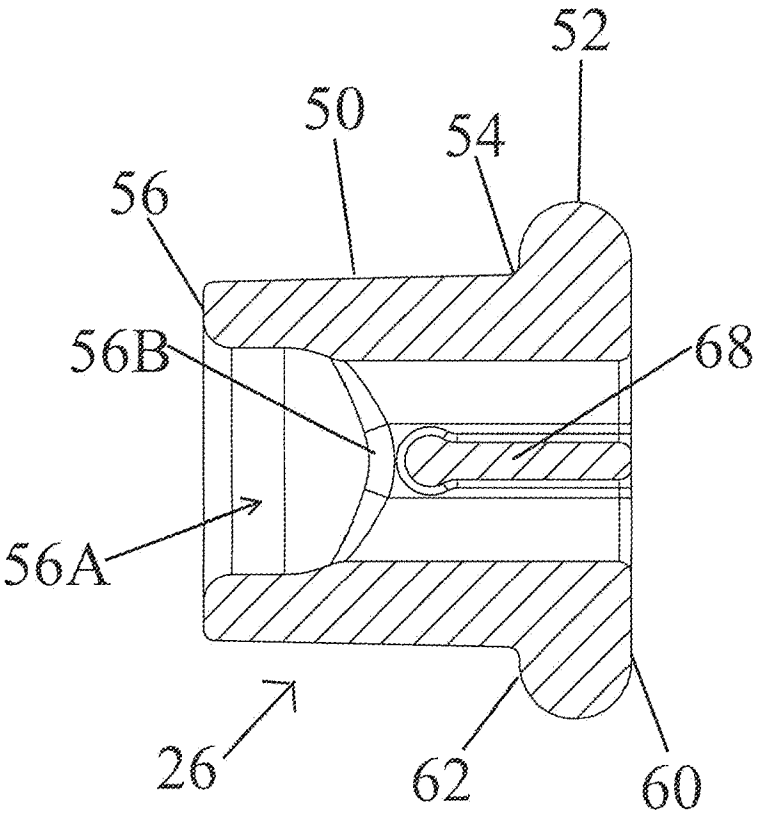
Figure 6:
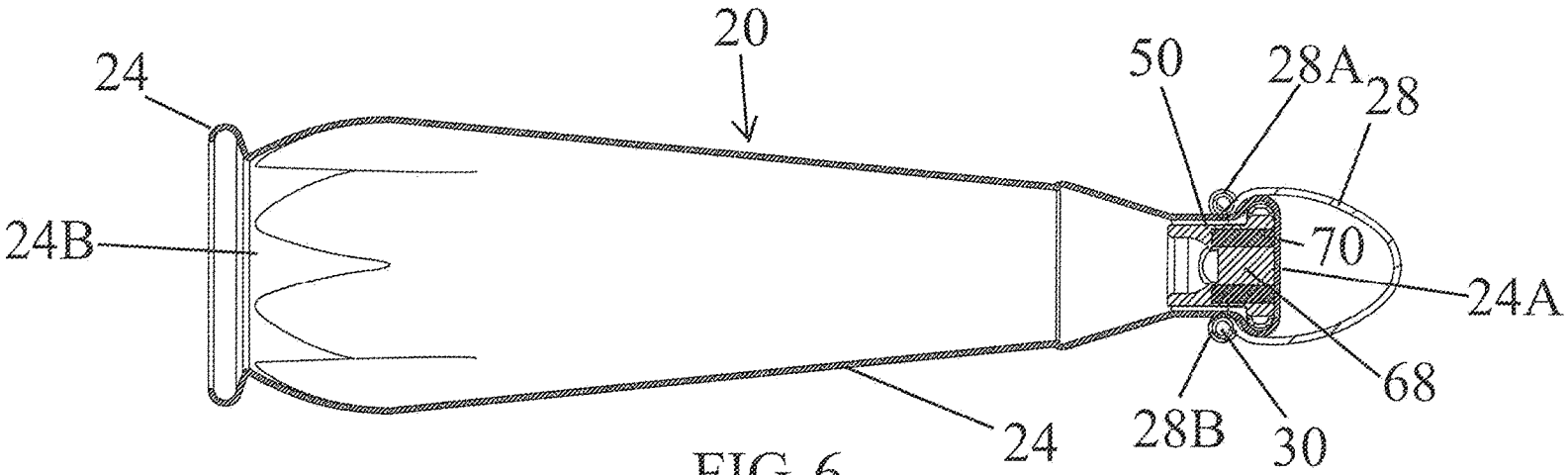
FIGS. 6 and 7 are sectional views of the resiliently stretchable pouch shown in FIG. 3, where the sectional view of FIG. 7 is taken through the resiliently stretchable pouch 90 degrees rotated from the resiliently stretchable pouch shown in FIG. 6.
Figure 7:
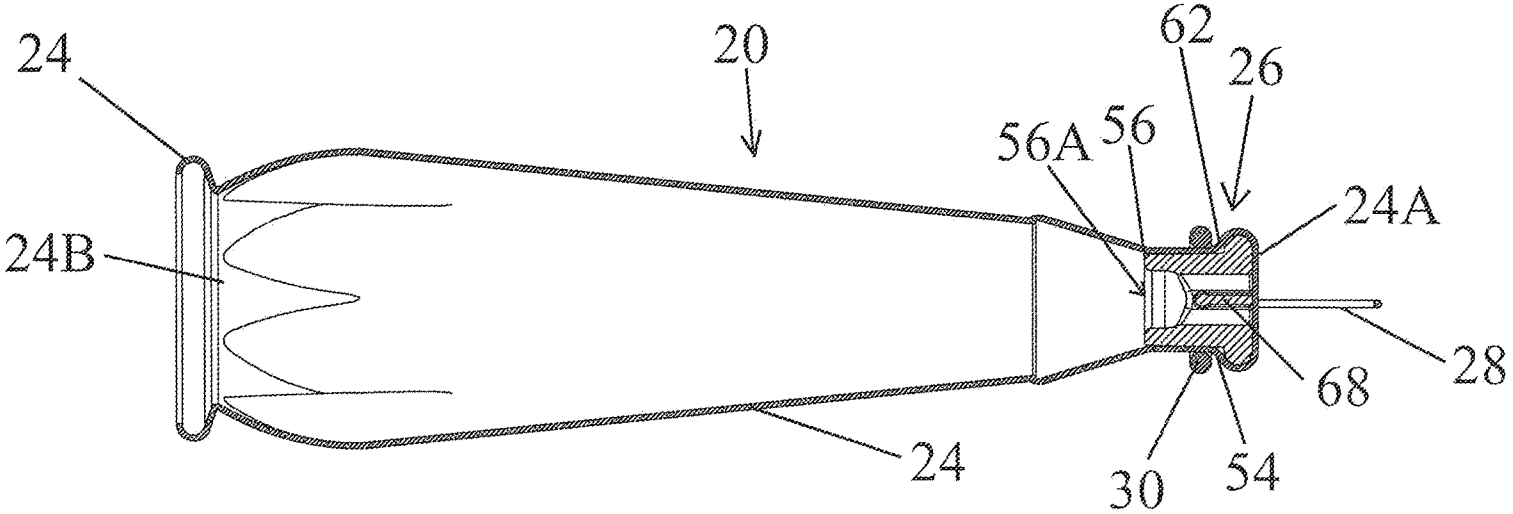
Figure 13A:
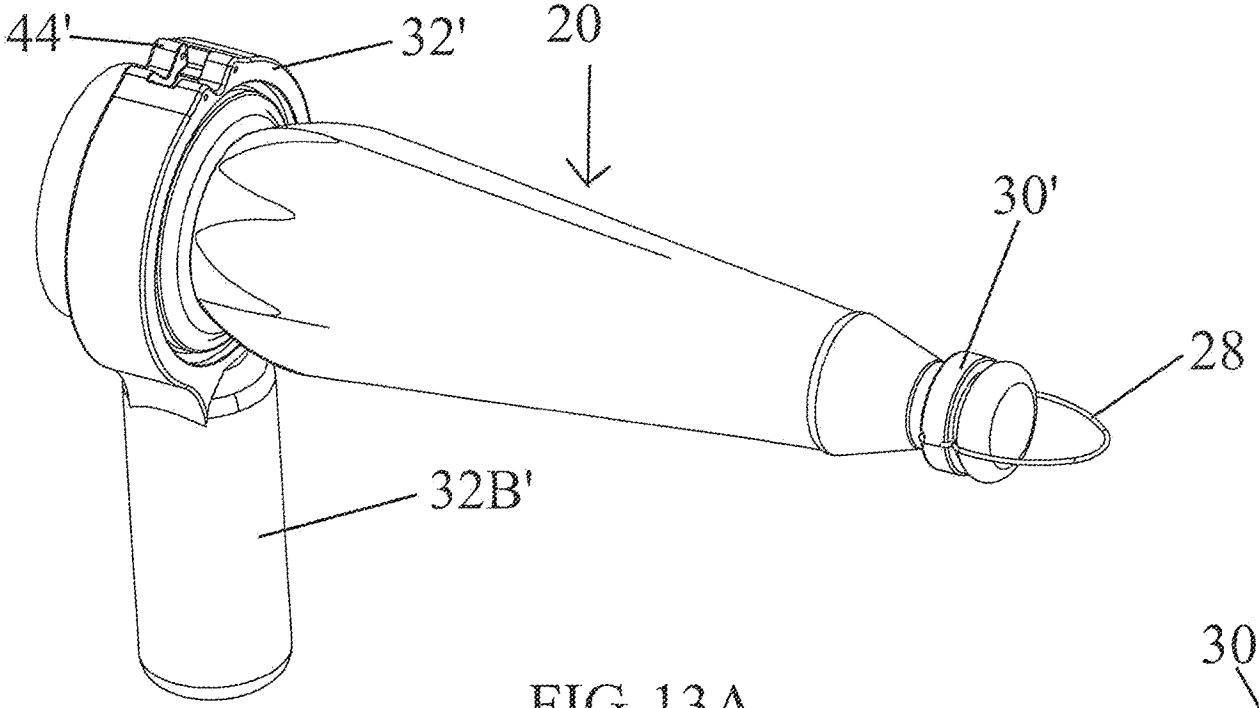
FIG. 13A is a perspective view of another embodiment of a resiliently stretchable pouch using a different embodiment of a cylindrical ring.
Figure 13B:
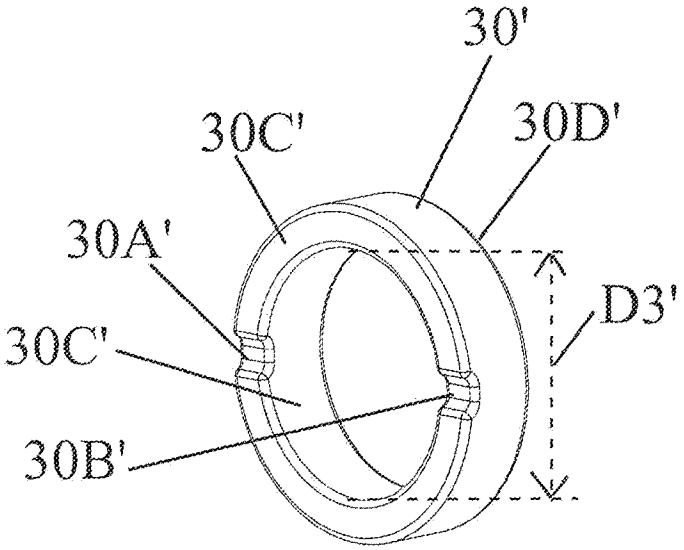
FIG. 13B is a perspective view of the cylindrical ring used with the resiliently stretchable pouch of FIG. 13A.

In yet another alternative embodiment mentioned above and shown in FIGS. 13A-13B, a generally flat cylindrical ring 30' (FIG. 13B) is shown for use with the resiliently stretchable pouch 20. As described earlier, an inner diameter D3' varies in length as across the surface so that the diameter at end 30C' is smaller than the diameter D3' at end 30D'. In this configuration, as ring 30' is slid over resiliently stretchable pouch 20 and seated on insert first body 50, the ring wedges onto the insert first body first end 54 adjacent insert second body second end 62 (FIG. 5A). This occurs because diameter D1 of insert first body also varies from insert first body first end 54 to insert first body second end 56 (FIG. 5A) where D1 at insert first body first end 54 is larger than D1 at insert first body second end 56. Ring recesses 30A' and 30B' allow the ends of loop 28 to be seated in the recesses when loop 28 is coupled to ring 30'. The configuration of ring 30' allows the ring to better seat around resilient stretchable pouch 20 on insert 26 minimizing any rocking by ring 30'.

Figure 14B:
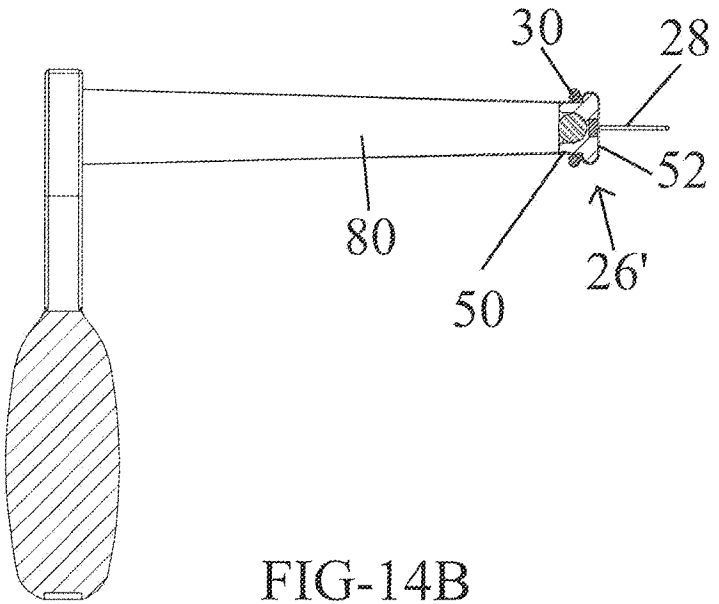
FIG. 14B is a cross sectional view of the slingshot of FIG. 14A.
Figure 14A:
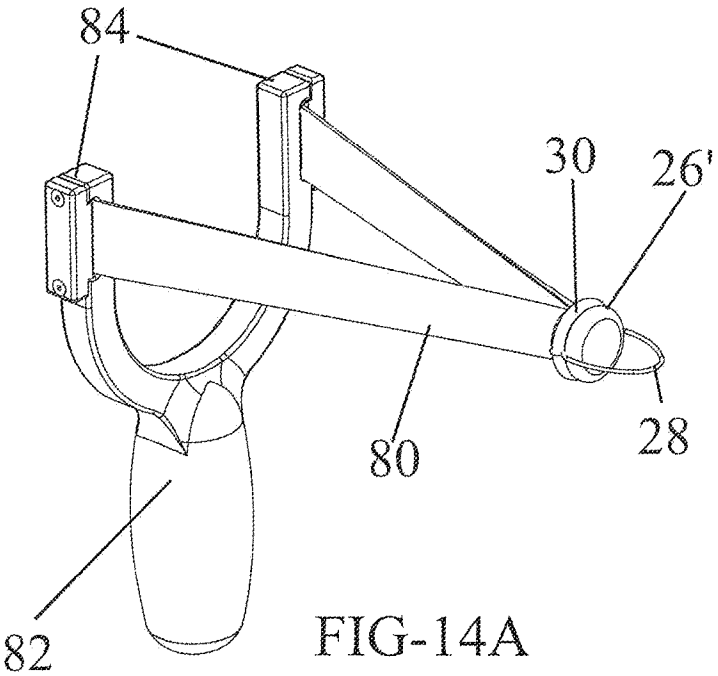
FIG. 14A is a perspective view of another embodiment of a slingshot.
Figure 14C:
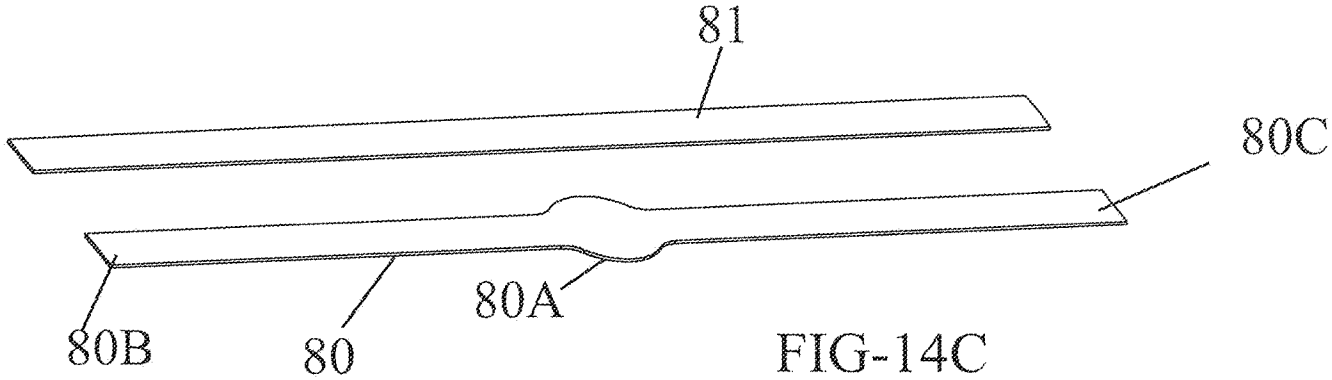
FIG. 14C are perspective views of resiliently stretchable bands for use in the slingshot of FIG. 14A or the slingshot rife of FIG. 1.

Finally, referring to FIGS. 14A-14C, another embodiment of a slingshot is shown where the resiliently stretchable pouch 20 of the previous FIGS. 11 and 12 are replaced with one or more of resiliently stretchable bands 80 and 81 or a combination of bands 80 and/or 81. In the embodiment disclosed, an insert 26' is seated on band 80 at a band insert section 80A. The first and second ends 80B and 80C are fed through ring 30 and ring 30 is moved down around insert first body 50 until it abuts with insert second body 52. The first and second ends of band 80 are then attached to respective sling shot arms 84 by any suitable means such as a press fitted connection, etc. Sling shot arms are coupled to a handle 84. In various embodiments, the slingshot arms 84 may be integrally formed with handle 84. The operation of the slingshot embodiment shown in FIGS. 14-14C is similar to the embodiment of the slingshot shown in FIGS. 11-12.

CONCLUSION

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. For example, ring 30 may be replaced with elongated cylindrical ring 30' in any of the various embodiments shown. In various embodiments, the elongated cylindrical ring 30' may have a constant inner diameter. In other embodiments, the elongated cylindrical ring may have a varying diameter to match the varying diameter of the insert first body. Moreover, in various embodiments, the resiliently stretchable pouch 20 of the slingshot rifle shown in the figures may be replaced with the resiliently stretchable bands 80 and/or 81. In some embodiments, one or more bands may be stacked on one another to increase the shooting velocity of the slingshot rifle or handheld slingshot. For example, two resiliently stretchable bands may be used together. In other embodiments, three or more resiliently stretchable bands may be stacked together and secured to an insert using one of rings 30 or 30'.

Therefore, it is to be understood that the invention is not to be limited to the specific embodiments disclosed herein, and that the modifications and other embodiments are intended to be included within the scope of the appended exemplary concepts. Although specific terms are employed herein, they are used in a generic and descriptive sense only and not for the purposes of limitation.

What is claimed:

1. A sling shot rifle comprising:

a. an elongated rail having a first end and an opposite second end;

b. a stock operatively coupled to the first end, wherein the stock further comprises:

i. a trigger operatively coupled to the stock; and ii. a catch operatively coupled to the trigger;

c. a slidable grip operatively coupled to the elongated rail intermediate the first end and the second end;

d. a generally cylindrical body slidably received on the elongated rail intermediate the slidable grip and the elongated rail second end, wherein the generally cylindrical body further comprises;

i. a resiliently stretchable pouch operatively coupled to the generally cylindrical body, the resiliently stretchable pouch further comprising:

a) a closed first end having a loop operatively attached thereto and configured to engage with the catch; and b) an open second end;

ii. a spring-loaded locking pin operatively coupled to the generally cylindrical body wherein the spring-loaded locking pin is configured to lock the generally cylindrical body to a particular position along the elongated rail intermediate the elongated rail first end and the elongated rail second end;

e. the resiliently stretchable pouch further comprising an insert operatively received in the resiliently stretchable pouch closed first end, the insert comprising:

a. a first body comprising:

i. a first end;

ii. an opposite second end;

iii. a first diameter;

iv. a first length; and v. a cavity formed in the first body second end;

b. a second body comprising:

i. a second diameter; and ii. a second length;

c. a ring comprising a third inner diameter; and d. said loop comprising a first end and a second end wherein the loop first end and second end are operatively coupled to the ring;

wherein, the second body is positioned adjacent to the first body first end;

the first diameter is smaller than the second diameter;

the third inner diameter is substantially the same or slightly larger than the first diameter but smaller than the second diameter;

the first length is longer than the second length;

the insert is positioned in the resiliently stretchable pouch so that the first body second end cavity opening faces the resiliently stretchable pouch open second end; and the ring is received around an outside surface of the resiliently stretchable pouch over the insert first body proximate the insert first body first end and substantially abutting the insert second body.

2. The sling shot rifle of claim 1, wherein the resiliently stretchable pouch open second end is secured to a generally circular ring that is coupled to the generally cylindrical body.

3. The sling shot rifle of claim 2, wherein the generally circular ring is integrally formed with the generally cylindrical body.

4. The sling shot rifle of claim 2, further comprising an arrow rest coupled to the generally circular ring, wherein the arrow rest is selected from a group consisting of:

a. a cover comprising:

i. a circular opening centered on the cover and configured to allow an arrow shaft to slide therethrough; and ii. at least two openings extending radially from the circular opening that are configured to allow a fletching of an arrow to pass therethrough without interfering with the flight of the arrow; and b. a cover comprising radially inwardly pointing bristles that define an axial opening for supporting the shaft of the arrow; and c. a cover comprising a drop away arrow rest.

5. The sling shot rifle of claim 4, wherein the cover is made from a flexible material.

6. The sling shot rifle of claim 1, wherein the first body cavity contains a pin therein that is configured to engage an arrow nock.

7. The sling shot rifle of claim 1, further comprising at least one magnet received in a recess that is proximate to the cavity, wherein the at least one magnet is configured to hold a projectile in the insert.

8. The sling shot rifle of claim 1, wherein the loop is formed from a material selected from a group consisting of a metal wire, a polyester cord, or a naturally woven cord.

9. The sling shot rifle of claim 1, wherein the insert first body and the insert second body are integrally formed from a polymer.

10. The sling shot rifle of claim 1, wherein the first diameter is variable and is smaller at the first body second end and larger at the first body first end.

11. The sling shot rifle of claim 1, wherein the slidable grip further comprises:

a. a first body;
b. a second body pivotally coupled to the first body; and
c. a spring positioned intermediate the first body and the second body such that the spring biases the second body away from the first body;

wherein when the second body is squeezed toward the first body, a portion of the second body engages with the elongated rail thereby causing the slidable grip to be temporarily fixed to the elongated rail so as not to slide.

12. The sling shot rifle of claim 10, wherein the second body further comprises a friction material received by the second body such that when the second body is squeezed toward the first body, the friction material engages with the elongated rail causing the slidable grip to be temporarily fixed to the elongated body.

13. A sling shot rifle comprising:
a. an elongated rail having a first end and an opposite second end;
b. a stock operatively coupled to the first end, wherein the stock further comprises:
i. a first grip;
ii. a trigger operatively coupled to the first grip; and
iii. a catch operatively coupled to the trigger;
c. a body slidably received on the elongated rail intermediate the stock and the elongated rail second end, wherein the slidable body further comprises;
i. a second grip portion;
ii. a mounting ring; and
iii. a spring-loaded locking pin operatively coupled to the slidable body wherein the spring-loaded locking pin is configured to lock the body to a particular position along the elongated rail intermediate the elongated rail first end and the elongated rail second end,
d. a resiliently stretchable pouch operatively coupled to the mounting ring, the resiliently stretchable pouch further comprising:
i. a closed first end;
ii. an open second end configured to be coupled to the mounting ring; and
iii. an insert comprising:
a) an insert body having a first end, an opposite second end, a axial cavity formed in the insert body second end where the back of the axial cavity is configured to receive a arrow nock, and a diameter;
b) a flange formed on the insert body first end wherein the flange comprises a second diameter that is larger than the insert body diameter; and
c) a ring positioned around an outside surface of the resiliently stretchable pouch proximate the first end so that the ring is received around the insert body proximate the insert body first end adjacent the flange; and
e. a loop having a first end and a second end, wherein the loop first end and the loop second end is operatively coupled to the ring at respective points that are opposite from each other, wherein the loop is configured to releasably couple to the catch.

14. The sling shot rifle of claim 13, wherein the insert body diameter varies between the insert body first and second ends such that the insert body diameter at the insert body first end is larger than the insert body diameter at the insert body second end.

15. The sling shot rifle of claim 14, wherein the ring further comprises:
a. a ring first end comprising a fourth diameter;
b. ring second end having a fifth diameter that is smaller than the fourth diameter, wherein the ring fourth and fifth diameters are smaller than the flange second diameter,
c. and a length between the ring first end and the ring second end, wherein the ring fourth diameter is substantially the same as the insert body diameter at the insert body first end so that as the ring is pulled toward the insert flange, the ring wedges onto the insert body.

16. The sling shot rifle of claim 13, wherein the loop is formed from a flexible material and the insert is formed from a polymer.

17. The sling shot rifle of claim 13, the insert further comprising at least one magnet operatively coupled in the insert body axial cavity such that the at least one magnet operates to magnetically retain a projectile in the insert.

18. A sling shot rifle comprising:
a. an elongated rail having a first end and an opposite second end;
b. a stock operatively coupled to the first end, wherein the stock further comprises:
i. a trigger operatively coupled to the stock; and
ii. a catch operatively coupled to the trigger;
c. a slidable grip operatively coupled to the elongated rail intermediate the first end and the second end, wherein the slidable grip is configured to be releasably retained at a particular point along the length of the elongated rail;
d. a body slidably received on the elongated rail intermediate the slidable grip and the elongated rail second end, wherein the slidable body further comprises a mounting ring; and
e. a resiliently stretchable pouch comprising:
i. a closed first end;
ii. an open second end configured to be operatively coupled to the mounting ring; and
iii. an insert comprising:
a) an insert body having a first end, an opposite second end, a cavity formed in the insert body second end and a first diameter wherein the back of the axial cavity is configured to receive an arrow nock;
b) a flange formed on the insert body first end wherein the flange comprises a second diameter that is larger than the first diameter; and
c) a ring positioned around an outside surface of the resiliently stretchable pouch proximate the resiliently stretchable pouch first end so that the ring is received around the insert body adjacent the flange; and
f) a loop comprises a first end and a second end, wherein the loop first end and the loop second end are operatively coupled to the ring at respective points that are opposite from each other on the ring, wherein the loop is configured to releasably couple to the catch.

19. The sling shot rifle of claim 18, wherein the slidable grip may be releasably retained in a manner selected from a group consisting of:
a. a pin that engages with the elongated rail;
b. a friction engagement between the slidable grip and the elongated rail; and
c. the force of the user holding the slidable grip in a particular position along the elongated rail.

* * * * *